United States Patent [19]

Nakamura et al.

[11] 4,175,589

[45] Nov. 27, 1979

[54] FLUID PRESSURE DRIVE DEVICE

[75] Inventors: Ichiro Nakamura, Katsuta; Ken Ichiryu, Mito; Masatoshi Kuwayama, Hitachi, all of Japan

[73] Assignee: Hitachi, Ltd., Japan

[21] Appl. No.: 800,948

[22] Filed: May 26, 1977

[30] Foreign Application Priority Data

Jul. 28, 1976 [JP] Japan ..... 51-89177

[51] Int. Cl.[2] ..... F15B 13/043

[52] U.S. Cl. ..... 137/625.64; 137/625.6; 91/459

[58] Field of Search ..... 137/625.64, 489, 625.6; 91/417 R, 459, 461

[56] References Cited

U.S. PATENT DOCUMENTS

| | | | |
|---|---|---|---|
| 2,775,982 | 1/1957 | Canfield | 91/417 R |
| 3,257,810 | 6/1966 | Hänni | 91/417 R |
| 3,433,266 | 3/1969 | Bidlack | 91/417 R |
| 3,498,329 | 3/1970 | McCormick | 137/625.64 |
| 3,999,464 | 12/1976 | Grieger et al. | 91/417 R |
| 4,041,840 | 8/1977 | Zirps | 91/417 R |

FOREIGN PATENT DOCUMENTS

| | | | |
|---|---|---|---|
| 2067780 | 8/1971 | France | 137/625.6 |
| 2112323 | 6/1972 | France | 137/625.6 |

*Primary Examiner*—Martin P. Schwadron
*Assistant Examiner*—A. Michael Chambers
*Attorney, Agent, or Firm*—Craig and Antonelli

[57] ABSTRACT

A fluid pressure drive device including a primary drive portion operated by receiving an operational command, and a secondary drive portion operated due to the operation of the primary drive portion. In this fluid pressure drive device, at least parts of movable members in the above both drive portions are overlapped so as to shorten the lengths of fluid passages. As a result, a time interval from the receiving of an operational command until the generation of a drive force in the final drive portion, i.e., a response time of the drive device may be shortened.

10 Claims, 8 Drawing Figures

FLUID PRESSURE DRIVE DEVICE

This invention relates to a fluid pressure drive device which is adapted to be operated at a high speed, and more particularly to a fluid pressure drive device having multiple stage drive portions which are operated in sequence by receiving an operational commands, and is well adapted for use in an equipment which is dictated to increase an output or a distance to drive, at a high speed.

For instance, a drive device for use with a circuit breaker for an electric power, for which breaker is required a high speed operation, includes a pilot portion, a main control portion, a drive portion and the like, and this drive device amplifies a command signal to be fed to the pilot portion. Many attempts have been proposed for achieving a high speed operation for the drive device of this type. For instance, an electromagnet and a push rod are provided in a pilot portion, with a pilot portion being provided separately of a control portion, so that there results an excessively long fluid passage connecting the both portions together, and hence a time expenditure in these portions is considerable, thus imposing a time limitation on the drive device. However, there has arisen a strong demand to increase an operational speed and an output of the drive devices, which have been used hitherto.

It is an object of the present invention to provide a fluid pressure drive device, in which at least parts of movable members in two drive portions are overlapped in the moving direction thereof to shorten the lengths of fluid passages, as well as a time interval from the receiving of an operational command until the generation of a drive force in the succeeding drive portion, while insuring a positive driving operation in response to an operational command.

It is another object of the present invention to provide a fluid pressure drive device, in which part of a spool forming part of a control portion is used in common with a sleeve in a pilot portion, thereby shortening the lengths of fluid passages for use in controlling the spool in the control portion by the pilot portion, or in which a sleeve in a pilot portion is coupled to a sleeve forming part of a control portion, so that a fluid pressure acting on a spool in the control portion is controlled by the pilot portion for controlling the movement of a spool in the control portion, with the result that the lengths of fluid passages for use in controlling the spool in the control portion by the pilot portion is shortened, thereby attaining the aforesaid object.

These and other objects and features of the present invention will be apparent from a reading of the ensuring part of this specification in conjunction with the accompanying drawings, in which.

The present invention will now be described in more detail with reference to the accompanying drawings which indicate embodiments of the invention, and in which with like parts are designated like reference numerals throughout the drawings.

Figure 1:
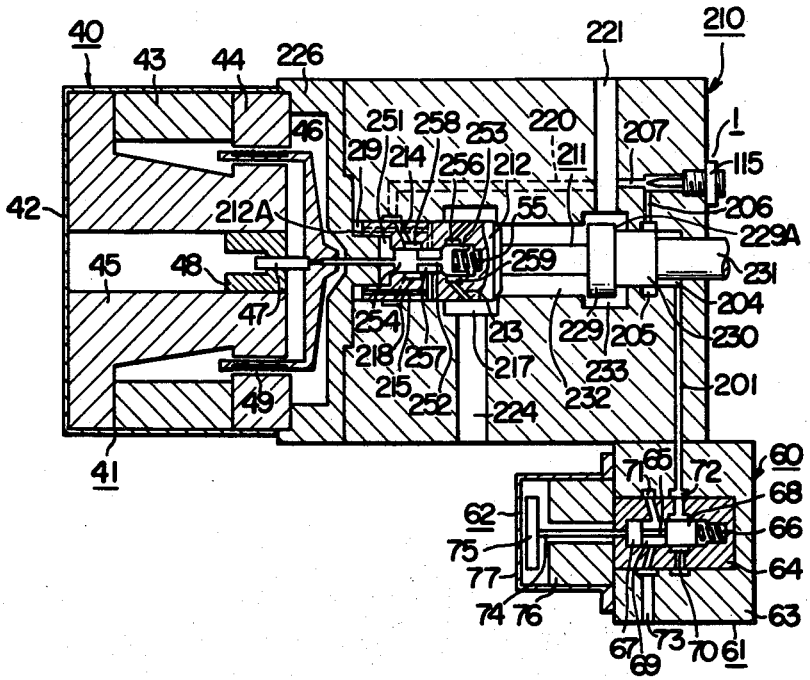
FIG. 1 is a longitudinal cross-sectional view of one embodiment of a fluid pressure drive device according to the present invention.

A fluid pressure drive device shown in FIG. 1 is applied to a steam passage shut-off valve for use with a steam turbine as an emergency means, and includes first and second primary drive portions 40, 60 adapted to be operated by receiving operational commands, and a secondary drive portion 210 operated in response to the operation of the primary drive portions. In this respect, the secondary drive portion 210, although not shown, operates a member adapted to open and close a steam passage.

The first primary drive portion 40 includes a drive mechanism 41, and a two-position-three ports change-over valve portion 251. The drive mechanism 41 is equipped with a ring-shaped permanent magnet 43 interioly of a cover 42. The permanet magnet 43 is provided with a ring-shaped yoke 44 at one end thereof, and a pole 45 at the other, which pole has one end positioned inwardly. A coil bobbin 46 of a bottomed cylindrical shape is positioned in a clearance defined between the pole 45 and the ring-shaped yoke 44 in a manner movable in the axial direction, while a center stem 47 of the coil bobbin 46 is slidably supported by a guide 48 secured to a center portion of the pole 45. In addition, a coil 49 is wound as a driving coil around the periphery of the bobbin 46 in opposed relation to the yoke 44, while a spool 252 in a change-over valve 251 is coupled to the center stem 47 on an opposite side of the bobbin 46. The spool 252 is inserted into a poppet 212 in a main valve spool 211 in a secondary drive portion 210. In other words, the poppet 212 is used in common with a sleeve in the change-over valve portion 251. In addition, the spool 252 is formed with a poppet 253, with a compression spring 55 confined between the poppet 253 and a poppet 212 of the main spool 211, in a manner that the both poppets 253 and 212 are so resiliently loaded as to depart from each other. Three fluid chambers 256, 257, 258 are defined between the spool 252 and the poppet 212 serving as a sleeve, and communicated, through fluid passages 213, 214, 215 provided in respective poppets 211, with a fluid chamber 217, fluid sump 218, and fluid chamber 219, respectively, while the fluid sump 218 is communicated through the fluid passage 220 with a fluid passage 221, in which a high pressure fluid prevails all the times. Accordingly, in a condition where the coil 49 is not energized and the spool 252 is biased to the left by means of the compression spring 55, a high pressure fluid in the fluid passage 221 is fed through fluid passages 220, 214, fluid chambers 258, 257 and fluid passage 215 to the fluid chamber 219, thereby biasing the poppet 212 to the right. On the other hand, when the spool 252 is driven to the right, then the spool land 254 shuts off the communication between the fluid chambers 257 and 258, thereby interrupting the inflow of a high pressure fluid, while the fluid chambers 256 and 257 are brought into communication with each other, thereby allowing delivery of a pressure fluid from the fluid chamber 219 through the fluid passage 215, pressure chambers 257, 256, and a fluid passage 213 to the fluid chamber 217. The fluid chamber 217 is communicated with a fluid passage 224 which in turn is connected to a tank not shown. Accordingly, when the spool 252 is driven to the right, then a high pressure fluid is discharged from the fluid chamber 219 into the tank, so that a force to bias the main valve spool 211 to the right is relieved. In addition, the poppet 253 includes a communicating hole 259 which brings a compression-spring-inserted portion into communication with the fluid chamber 256.

The secondary drive portion 210 includes a main valve spool 211 movable therein, and a sleeve retainer 226 at its one end. One of the sleeve retainers 226 is secured to a yoke 44 in the first primary drive portion 40.

The main valve spool 211 is formed with a spool land 229, and spool stem portions 230 and 231, in addition to the aforesaid poppet 212. The secondary drive portion 210 includes three fluid chambers 217, 232, 233. The fluid chamber 233 is communicated with the fluid passage 221, and the fluid chamber 217 is communicated with the fluid passage 224 communicated with a tank. A high pressure fluid acting on the fluid chamber 233 all the times also acts not only on the right-hand end surface of the poppet 212, and left-hand end surface of the spool land 229, but also on the right-hand end surface 229A of the spool land 229, thereby urging the spool 211 to the left all the times. At this time, a pressure bearing area of the right-hand end surface 229A, i.e., a difference in area between the end surface of the spool land 229 and the end surface of the spool stem portion 230 is so designed as to be smaller than an area of a pressure bearing surface of the spool, on which a pressure acts to the right from the fluid chamber 219 bounded by the left-hand end surface 212A of the spool 211.

The second primary drive portion 60 includes an auxiliary change-over valve 61, and a drive portion for the change-over valve 61. The change-over valve 61 is a two-port change-over valve which is adapted to open or close a path of a high pressure fluid flowing through the fluid passage 201. The change-over valve 61 includes an auxiliary valve body 63, in which there is provided a sleeve 64, with a spool 65 slidingly provided in the sleeve 64, and a compression spring 66 confined between the spool 65 and the sleeve 64. The spool 65 is formed with two spool lands 67, 68, while the sleeve 64 is provided with two fluid chambers 69, 70, both of which are communicated through fluid sumps 71, 72 with fluid passages 73, 201 which are communicated with a tank not shown. In addition, the drive portion 62 includes a plate 75 coupled through the medium of a push rod 74 to an end of the spool land 67 on one hand, an electromagnet 76 adapted to attract the plate 75 thereto, when energized, and a cover 77 adapted to cover the plate 75 and electromagnet 76. In the aforesaid auxiliary change-over valve 61, the fluid chamber 70 is closed with the spool land 68 with the aid of an action of the compression spring 66, so that there takes place no leakage of fluid from the fluid passage 201.

The fluid passage 201 is communicated through the fluid chambers 204, 205, and fluid passages 206, 207 with the fluid passage 221, in which a high pressure fluid prevails all the times. In a condition shown in FIG. 1, the fluid chambers 204, 205 are shut off from communication with each other, by means of the spool stem portion 230, and brought into mutual communication, when the main valve spool 211 is moved to the left. When the fluid chamber 204 is communicated with the fluid chamber 205, if the fluid passage 201 is closed with the spool land 68 of the spool 65 in the second primary drive portion 60, then a high pressure fluid acts on the right-hand end surface of the spool stem portion 230, as well, so that there is produced a force to bias the main valve spool 211 to the left. The sum of a pressure bearing area of the spool stem portion 230 and the pressure bearing area of the right-hand end surface 229A of the spool land 229 is larger than a pressure bearing area of the left-hand ene surface 212A of the spool 211. Accordingly, in case a high pressure fluid acts on the two fluid chambers 219, 233 alone, then the main spool 211 is urged to the right. However, once the spool 211 is biased to the left and hence a high pressure fluid is accumulated in the fluid chamber 204, even if a high pressure fluid flows into the fluid chamber 219, then a force to urge the spool 211 to the left takes superiority over the other, so that the spool 211 is maintained biased to the left. When the spool 65 in the second primary drive portion 60 is moved from the above condition to the right, and then a high pressure fluid is discharged from the fluid chamber 204, then a force acting on the spool 211 to the right takes superiority over the other, so that the spool 211 is biased to the right to an initial position.

A throttle or restriction portion 1 is provided with a throttle valve 111, one end of which is threaded so as to move back and forth, and the other end of which faces a valve seat provided at an intersection of the fluid passage 207 with the fluid passage 206, while a fluid chamber is provided in an intersection of the fluid passage 207 with the passage 206. In addition, an O-ring 114 is provided between the throttle valve 111 and the wall of secondary drive portion 210, while a lock nut 115 is threaded on a portion of the throttle valve 111, which projects from the sleeve 16, so that the throttle valve 11 is fixedly positioned.

With the aforesaid embodiment, the first primary drive portion 40 may be changed over at a high speed by means of the permanet magnet 43 (or electromagnet) and coil serving as a driving coil, and in addition the lengths of fluid passages for use in driving the main spool 211 may be extremely shortened, so that a time lag in transmission of a signal from the first primary drive portion 40 to the secondary drive portion 210 and vice versa may be minimized, so that a time interval from the receiving of an opening command until the generation of a drive force in the secondary drive portion may be shortened to a great extent, thus enabling a much higher speed operation for a shut-off valve.

Even in case an opening command or a closing command is maintained only for a short time, the aforesaid command may be practiced positively, because of the relationship in pressure bearing area between the main valve spool 211 in the secondary drive portion 210 and the first and second primary drive portions 40, 60 and, in addition, the aforesaid command may be retained until another command is fed. In addition, since the main valve spool 211 and spool 252 in the first primary drive portion 40 move in the opposite directions, the both spools need not be moved at a time for an intended operation.

Description will now be turned to a fluid pressure drive device applied to a breaker for an electric power, which is used in a power plant or a substation, say, a one cycle breaker as shown in FIGS. 3 to 6.

Figure 3:
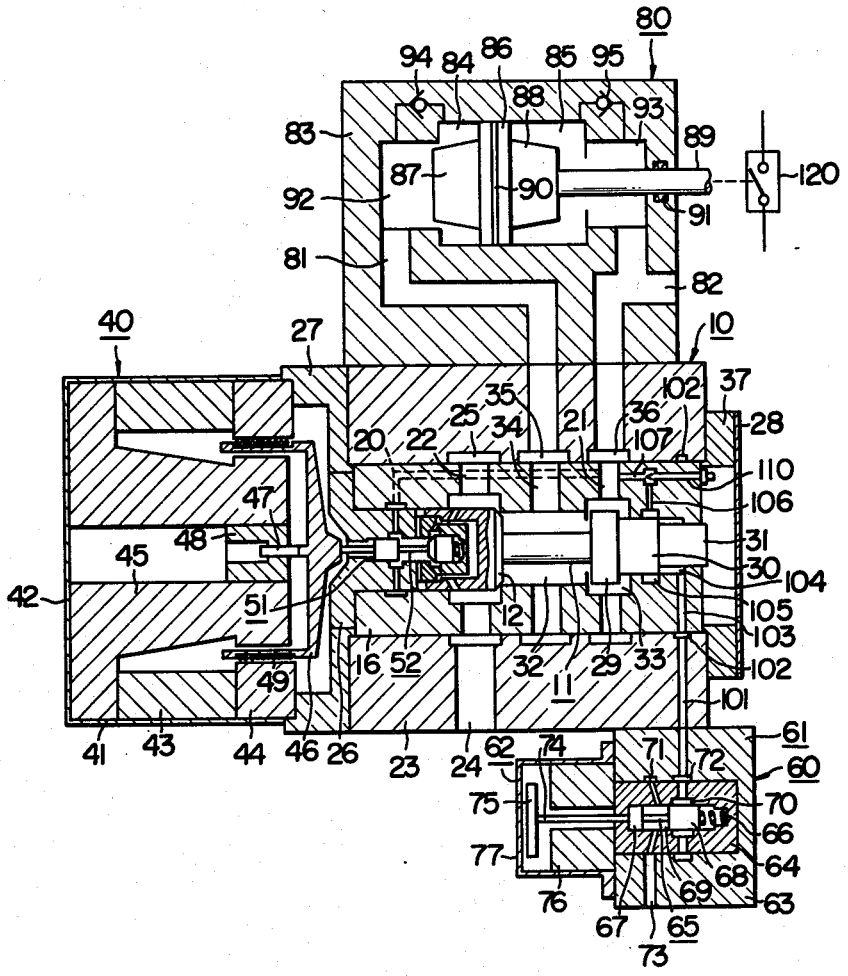
FIG. 3 is a longitudinal cross-sectional view of another embodiment of the fluid pressure drive device, which is applied to a breaker for an electric power.

FIG. 3 shows an entire arrangement of a fluid pressure drive device. This drive device includes a control portion 10 (corresponding to the secondary drive portion in FIG. 1), first and second pilot portions 40, 60 (corresponding to the first and second primary drive portions in FIG. 1) which are attached to the control portion 10 and amplifies an operational command signal to transmit same to the control portion 10, and a drive portion 80 (corresponding to a third drive portion 80 added to the embodiment of FIG. 1), the direction of its movement being controlled by the control portion 10.

Meanwhile, in the case of a breaker of this type, there are used two types of operational commands, i.e., an opening command, and a closing command for contactors. In this embodiment, an opening command is fed to the first pilot portion 40, while a closing command is fed to the second pilot portion 60. In addition, in the case of an electric power breaker, the drive device should be operated at a high speed in response to an opening command, while the drive device may be operated slowly in response to a closing command. Accordingly, in this embodiment, the drive device is so designed so to be operated by the first pilot portion 40 at a high speed in response to an opening command.

Figure 4:
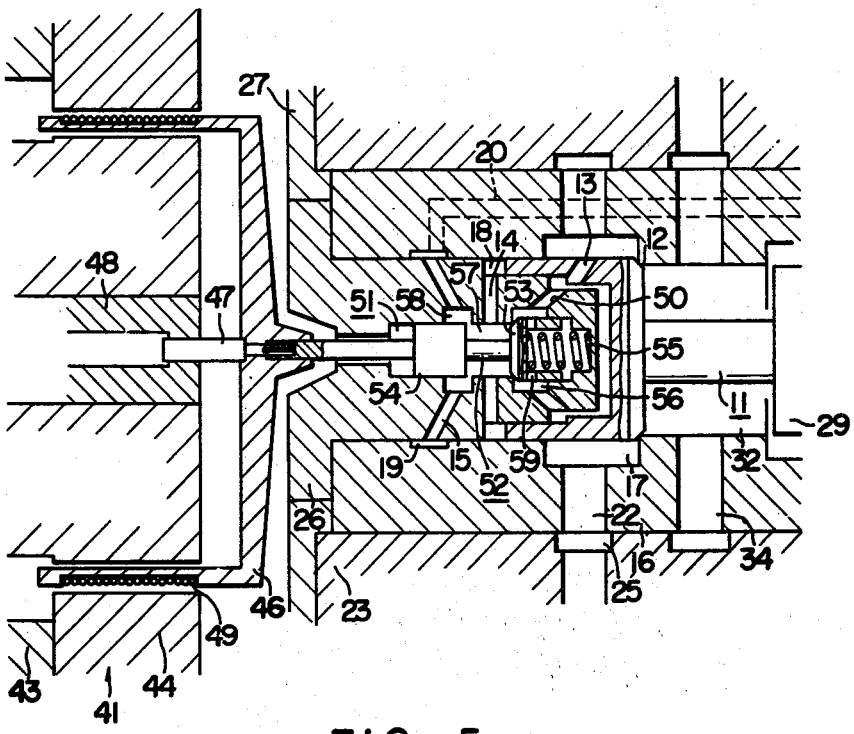
FIG. 4 is an enlarged cross-sectional view showing essential parts of a pilot portion and a control portion thereof.

The first pilot portion 40 includes a drive mechanism 41 and a change-over valve portion 51 constituting a two-position-three-port-change-over valve. The drive mechanism 41 has a ring-shaped permanent magnet 43 internally of a cover 42. The permanent magnet 43 is provided with a ring-shaped yoke 44 at its one end, and a pole 45 contacting the other end of the magnet 43, with one end of the pole 45 positioned internally of the york 44. A bottomed-cylindrical coil bobbin 46 is axially movable within a clearance defined between the pole 45 and the ring-shaped yoke 44, while a center stem 47 of the coil bobbin 46 is slidingly supported in a guide 48 secured to the center portion of the pole 45. A coil 49 serving as a driving coil is wound around an outer periphery of the bobbin 46 in opposed relation to the yoke 44, while a spool 52 in the change-over valve portion 51 is coupled to the bobbin 46 on a side opposite to the center stem 47. The spool 52 is slidingly inserted in a sleeve 26 in the pilot portion, and fitted in the main valve sleeve 16 in the control portion 10, with its tip of the inserted portion of the spool 52 having a small diameter so as to be slidingly inserted into the poppet in the main valve spool 11 in coaxial relation thereto. As shown in FIG. 4, the spool 52 is formed with a poppet 53 and a spool land 54, while a compression spring 55 is confined between the inner surface of the inserted tip portion of the pilot sleeve 26 and the poppet 53, which is urged in the direction to protrude from the sleeve 26. Three fluid chambers 56, 57, 58 are defined between the spool 52 and the sleeve 26, and communicated, through the fluid passages 13, 50, 14, 15 provided in respective poppets 12 and sleeve 26, with fluid chambers 17, 18 and a fluid sump 19 provided in the main valve sleeve 16 in the control portion 10, while the fluid sump 19 is communicated via the passage 20 with the fluid passage 21 in the main valve sleeve 16, which passage is filled with a high pressure fluid. Accordingly, in a condition shown, wherein the coil 49 is not energized, and the spool 52 is biased to the left under the action of a compression spring 55, a high pressure fluid is supplied through the fluid passage 21 via fluid passages 20, 15, fluid chambers 58, 57, and fluid passage 14 into the fluid chamber 18, so that the poppet 12 is biased to the right. On the other hand, when the spool 52 is driven from a condition shown to the right, communication between the fluid chambers 57 and 58 is shut off by the spool land 54, so that inflow of a high pressure fluid is interrupted, and then the fluid chambers 56 and 57 are brought into communication with each other, while a pressure fluid is supplied from the fluid chamber 18 via fluid passage 14, fluid chambers 57, 56 and fluid passages 50, 13 to the fluid chamber 17. The fluid chamber 17 is conducted to the fluid passage 22 provided in the main valve sleeve 16, and then the fluid passage 22 is communicated via the fluid sump 25 with the fluid passage 24 in the main valve body 23 fitted on an outer periphery of the main valve sleeve 16. In addition, the fluid passage 24 is connected to a tank not shown. Accordingly, when the spool 52 is driven from a condition shown to the right, then a high pressure fluid is discharged from the fluid chamber 18 into a tank, so that a force to urge the main valve spool 11 to the right is relieved. In addition, the poppet 53 has a communicating hole 59 which communicates a portion, into which the compression spring 55 is inserted, with the fluid chamber 56.

The control portion 10 is provided in the form of a two-position-three-port-change-over valve. In the control portion 10, a main valve sleeve 16 is fitted in the main valve body 23, and then a main valve spool 11 is movably housed interiorly of the main valve sleeve 16. In addition, the opposite ends of the main valve sleeve 16 are provided with sleeve retainers 27, 37 for use in coupling the sleeve 16 to the main valve body 23, respectively. The sleeve retainer shown to the left in FIG. 3 has one side-surface thereof secured to the yoke 44 in the first pilot portion 40, while a cover 28 is attached to the other sleeve retainer 37 shown to the right in FIG. 3.

The main valve spool 11 includes a spool land 29, spool stem portions 30 and 31, in addition to the aforesaid poppet 12. Three fluid chambers 17, 32, 33 are provided in the main valve sleeve 16. The fluid chambers 17, 32, 33 are communicated through fluid passages 22, 34, 21 and fluid sumps 25, 35, 36 with the fluid passage 24 leading to a tank, and fluid passages 81, 82 in a drive portion 80. The fluid passage 82 leads to a high pressure fluid source. High pressure fluid acting on the fluid chamber 33 all the times acts not only on the right-hand end surface of the poppet 12, and left-hand end surface of the spool land 29, but also on the right-hand end surface 29A of the spool land 29 (FIG. 5), thereby urging the spool 11 to the left all the times. A pressure bearing area of the right-hand end surface 29A at this time, i.e., a difference in cross sectional area between the spool land 29 and the spool stem portion 30 is so designed as to be smaller than a pressure bearing area of a left-hand end surface 12A of the spool 11 which bears a pressure in the fluid chamber 18 so as to move the spool 11 to the right.

The second pilot portion 60 includes an auxiliary change-over valve 61 and a drive portion for the change-over valve 61. The change-over valve 61 is provided in the form of a two-position-three-port-change-over valve adapted to open and close the path of a high pressure fluid in a fluid passage 101 to be described hereinafter. The change-over valve 61 has a sleeve fitted in an auxiliary valve body 63, while a spool 65 is slidably positioned within the sleeve 64. A compression spring 66 is confined between the spool 65 and the sleeve 64. The spool 65 is formed with two spool lands 67, 68, while the sleeve 64 includes two fluid chambers 69, 70 which are communicated via fluid sumps 71, 72 with a fluid passage 73 connected to a tank not shown and a fluid passage 101 in the main valve body 23. In addition, the drive portion 62 includes a plate 75 coupled through the medium of a push rod 74 to the end of the spool land 67, and an electromagnet 76 adapted to attract the plate 75 thereto, when energized, and a cover 77 covering the plate 75 and electromagnet 76. The fluid chamber 70 in the auxiliary change-over valve 61 is closed with the spool land 68 under the action of the compression spring 66, so that no fluid leakage takes place from the fluid passage 101.

The fluid passage 101 is communicated via a fluid sump 102 with a fluid passage 103 in the main valve sleeve 16, and then with a fluid 21, wherein a high pressure fluid prevails all the times, through fluid chambers 104, 105, fluid passages 106, 107 and a throttle portion 110 provided at a junction of the fluid passages 106 and 107. In a condition shown in FIG. 3, the fluid chambers 104, 105 are closed with the spool stem portion 30, and adapted to be communicated with each other, when the main valve spool 11 is displaced to the left. When the fluid chambers 104 and 105 are in communication with each other, in case the fluid passage 101 is closed with the spool land 68 of the spool 65, then a high pressure fluid acts on the right-hand end surface of the spool stem portion 30, so that a force is produced to urge the main valve spool 11 to the left. A sum of a pressure bearing area of the spool stem portion 30 and a pressure bearing area of the right-hand end surface 29A of the spool land 29 is so designed as to be larger than a pressure bearing area of the left-hand end surface 12A of the spool 11. Accordingly, in case a high pressure fluid acts on the two fluid chambers 18, 33 alone, the main valve spool 11 is biased to the right. However, once the spool 11 is moved to the left and then a high pressure fluid is accumulated in the fluid chamber 104, even if a high pressure fluid flows into the fluid chamber 18, a force to urge the spool 11 to the left takes superiority over the other, so that the spool 11 maintains its leftwardly biased condition. When the spool 65 in the pilot portion 60 is moved to the left and a high pressure fluid is relieved from the fluid chamber 104, then a force to urge the spool to the right takes superiority over the other, so that the spool 11 is biased to the right to return to the condition shown. The throttle portion or restriction 110 is of such an arrangement shown in FIG. 2.

The drive portion 80 is provided in the form of a differential cylinder which provides cushions in the opposite directions. The drive portion 80 includes a cylinder 83 having fluid passages 81, 82, while a piston 86 of slidingly fitted in the cylinder 83, thereby defining two pressure chambers 84, 85 therein. The piston 86 is provided with cushions 87, 88 on the opposite sides thereof, while the cushion 88 is coupled to the other end of the piston rod 89, which protrudes from the cylinder 83. In addition, one end of the rod 89 on its protruding side is coupled to a contacter of a breaker 120. Packings 90, 91 are secured to the piston rod 89 in sliding contact with the cylinder 83. The fluid passages 81, 82 are communicated via pressure chambers 92, 93 with the pressure chambers 84, 85, and via fluid passages 34, 21 in the control portion 10 with the fluid chambers 32, 33, respectively. Check valves 94, 95 are provided between the pressure chambers 84 and 92, and between the pressure chambers 85 and 93, respectively. The check valves 94, 95 allow the flow of a fluid from the pressure chambers 92, 93 leading to fluid passages 81, 82 to the pressure chambers 84, 85 on the side of the piston 86.

Description will be turned to the operation of the aforesaid embodiment.

Figure 5:
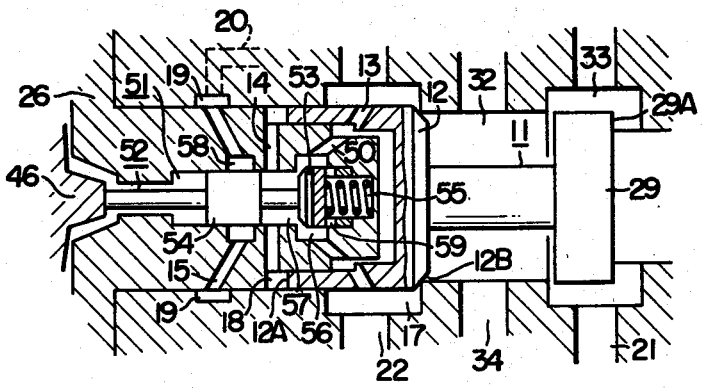
FIGS. 5 and 6 are views illustrative of the operations thereof.

When a current is fed to the coil in the first pilot portion 40 according to an opening command to the electric power breaker 120, then the spool is driven from a position shown in FIG. 4 to the right against the action of the compression spring 55, to a position shown in FIG. 5. As a result, communication between the fluid chambers 58, 57 is shut off by the spool land 54, so that the flow of a pressure fluid through the fluid passage 20 to the fluid chamber and then into the fluid chamber 57 is interrupted or blocked, while the fluid chambers 57, 56 are brought into communication with each other, so that a pressure fluid is delivered from the fluid chamber 18 via fluid passage 14, fluid chambers 57, 56 and fluid passages 50, 13 into the fluid chamber 17 and then through the fluid passage 22 into a tank. As a result, a fluid pressure acting on the left-hand end surface 12A of the poppet 12 in the main spool 11 is relieved, so that a force to urge the spool 11 to the right is lowered. On the other hand, since a fluid pressure acts on the right-hand end surface 29A of the spool land 29 all the times, the spool 11 is urged to the left because of the relationship between a force of fluid pressure acting on the left-hand end surface 12A and a force of a fluid pressure acting on the right-hand end surface 29A. Accordingly, a right-hand end surface of the spool stem portion 30 brings the fluid chambers 105, and 104 into communication with each other, so that a high pressure fluid flows into the fluid chamber 104, and a fluid pressure acts on the right-hand end surface of the spool stem portion 30, as well, with the result that the spool 11 is strongly moved to the left due to a force of a fluid pressure acting on the stem portion 30, in addition to a fluid pressure acting on the right-hand end surface 29A of the spool land 29, thereby assuming a position in FIG. 6. As a result, the poppet 12 in the main valve spool 11 is detached from a valve seat 16A, while communication between the fluid chambers 32 and 33 is shut off by the spool land 29. Accordingly, a pressure fluid from a pressure fluid source is shut off in the fluid chamber 32, while the fluid chamber 32 leading to the pressure chambers 92, 84 in the drive portion 80 is communicated via fluid chamber 17, fluid passage 22 and 24, with a tank. As a result, a pressure fluid is discharged from the pressure chambers 92, 84 on the left side of the piston, and then the pressure therein are sharply lowered. On the other hand, the pressure chambers 93, 85 on the right side of the piston 86 are communicated with a fluid pressure source via fluid passage 82 with a high pressure fluid all the times, so that the piston 86 is moved to the left because of the relationship of forces of fluid pressures acting on the left- and right-hand end surfaces of the piston 86, so that contactors in the breaker 120 are opened by the medium of the piston rod 89. In this case, the drive device 41 in the pilot portion 40 is provided in the form of a moving coil type, so that the drive device 41 is operated at a higher speed, as compared with a conventional device. In addition, the lengths of the exhaust fluid passages 14, 50, 13 for a pressure fluid, in the change-over valve portion 51 including a spool 52 coupled to a coil retainer 46 may be shortened almost as short as half a radius of the poppet 12, thereby shortening a time lag in transmission of a pressure from a pressure source to a large extent. As a result, a time interval from the receiving of an opening command by the first pilot portion 40 through the control portion 10 until the generation of a driving force in the piston 86 may be shortened to a large extent, for instance, half the time which has been required for the prior art device. Furthermore, the spool 52 in the pilot portion 40 and main valve spool 11 are driven in the opposite directions according to an opening command, so that an instable motion of the spool 52 in the pilot portion 40 due to the motion of the main valve spool 11 may be prevented.

Figure 6:
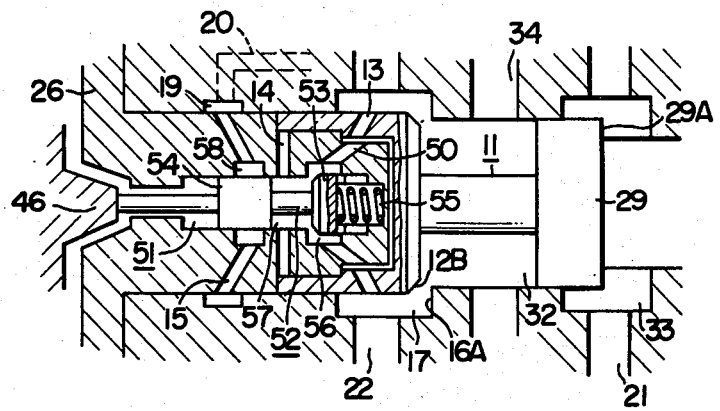

Meanwhile, with the aforesaid arrangement of the main valve spool 11, even if an opening command to the pilot portion 40 is cut off for a short time, and hence the positional relationship between the sleeve 26 and the spool 52 is restored to a condition shown in FIG. 4, so that a pressure fluid flows into the fluid chamber 18, the positional relationship between the main valve spool 11 and the sleeve 16 may be maintained in a condition shown in FIG. 6 positively. In other words, a pressure bearing area of the left-hand end surface 12A of the poppet 12 is so designed as to be smaller than a sum of a pressure bearing in area of the right-hand end surface 29A of the spool land 29 and a pressure bearing area of the right-hand end surface of the spool stem portion 30.

For bringing to a closed condition an open condition of a breaker, which has been given by an opening command fed to the first pilot portion 40, a closing command is issued to the second pilot portion 60. When a closing command is fed to the pilot portion 69 and hence the electromagnet 76 is energized, then the plate 75 is attracted to the electromagnet 76 due to its magnetic force produced, so that the spool 65 is driven to the right against the action of the compression spring 66. As a result, the fluid chambers 69 and 70 are brought into communication with each other, and the pressure chambers 105, 104 in the control portion 10 are communicated with a tank via fluid passages 103, 101, fluid chambers 70, 69, and fluid passage 73. Acocrdingly, a high pressure fluid which has been acting on the pressure chamber 104 in the control portion 10, with the main valve spool 11 biased to the left according to an opening command, is discharged through the aforesaid fluid paths to a tank, so that a force acting on a right-hand end surface of the spool stem portion 30 is released. As a result, the spool 11 is moved to the right due to a force acting on the left-hand end surface 12A of the poppet 12 having a large pressure bearing area, and then returned to a position shown in FIG. 3. Thus, communication between the fluid chambers 17 and 32 is shut off by means of the poppet 12, while the fluid chambers 32 and 33 are brought into communication with each other, with the result that a high pressure fluid flows through the fluid passage 82 via fluid passage 21, fluid chambers 33, 32 and fluid passage 81, into the pressure chambers 92, 84 on the left side of the piston 86 in the drive portion 80, and thus the piston 86 is biased to the right due to a difference in force produced due to a difference in pressure-bearing area between the left- and right-hand end surfaces of the piston 86, i.e., a difference corresponding to a cross sectional area of the rod 89, with the result that the contactors in the breaker 120 are closed.

As is clear from the foregoing description, even if the main valve spool 11 is returned to a condition shown in FIG. 3, after which a command to the second pilot portion 60 is relieved and hence the spool 65 in the pilot portion 60 assumes a position in FIG. 3, i.e., a condition where communication between the pressure chamber 104 in the control portion and a tank is shut off, the fluid chambers 105, 104 remain shut-off by means of the spool stem portion 30, so that a pressure in the fluid chamber 104 will not be built up to a level to bias the main valve spool 11 to the left, again.

Figure 2:
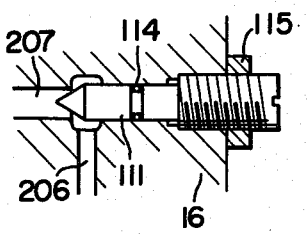
FIG. 2 is an enlarged cross-sectional view of a throttle portion thereof.

On the other hand, the throttle portion is of an arrangement of FIG. 2, and a pressure fluid is discharged from the fluid chamber 104 due to the second pilot portion 60 being operated according to a closing command. This however controls in an optimum condition the relationship between the discharge flow rate and an intake flow rate of a fluid into the fluid passages even during discharge of a pressure fluid. Stated differently, a clearance between the throttle valve 111 and its cooperative valve seat may be controlled so that an intake flow rate does not exceed the discharge flow rate, and there a position of the valve 111 is fixed by means of a lock nut 115.

According to this embodiment, the pilot portion 40 may be changed over at a high speed by means of the permanent magnet 43 and the coil 49 serving as a driving coil, and in addition the lengths of respective fluid passages adapted to drive the main valve spool 11 may be extremely shortened, so that a time lag in signal-transmission between the pilot portion 40 and the control portion 10 may be shortened, with the resulting shortened time interval from the receiving of an opening command until the generation of a drive force in the drive portion 80. This enables a high speed operation for a breaker, which could not have been attained hitherto.

In addition, even if an opening command or a closing command is issued for a quite short time, the command may be positively practiced, because of the relationship in pressure bearing area between the first and second pilot portions 40, 60, and the main valve spool 11 in the control portion 10, and in addition the aforesaid command may be retained until another command is received. Still furthermore, since the main valve spool 11 and spool 52 in the pilot portion 40 are moved in opposite directions relative to the main valve sleeve 16 and sleeve 26 which are fixed members, the relative position thereof may be maintained constant during the operation.

In addition, the main valve sleeve 16 is separated from the sleeve 26 in the pilot portion and fitted on the latter in coaxial relation, thus facilitating the machining thereof.

Figure 7:
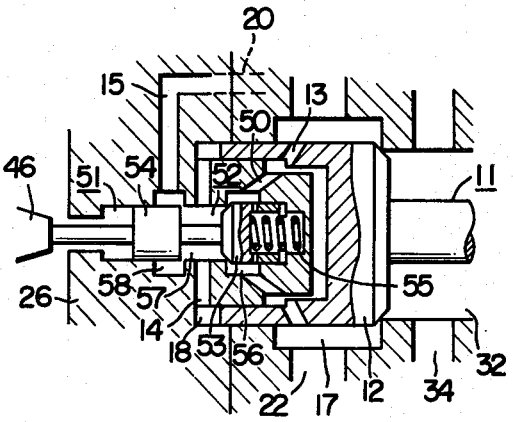
FIG. 7 is an enlarged cross-sectional view of an essential part of a further embodiment of the present invention.

As can be seen from FIGS. 4 to 6, the fluid pressure drive device of FIG. 1 may be applied to a breaker in FIGS. 4 to 6, as well as to an embodiment of FIG. 7.

The embodiment of FIG. 7 is similar to the preceding embodiment except for a difference in a coupling condition of the main valve sleeve 16 to the sleeve 26 in the pilot portion, with like parts being designated like reference numerals, and thus the description thereof will be omitted. In the preceding embodiment, the sleeve 26 in the pilot portion is press-fitted in the main valve sleeve 16, while in this embodiment, the sleeve 26 is coupled to the sleeve 16 on their mating surfaces, with part of the sleeve 26 in the pilot portion being slidingly fitted in the poppet 12 in the main valve spool 11. The function of the aforesaid arrangement remains the same as that of the preceding embodiment. Since the sleeves 16 and 26 are not press-fitted together, a centering operation of the both sleeves 16, 26 may be much simplified.

Meanwhile, in this embodiment, other arrangements may be adopted for the drive mechanism 41 in the first pilot portion 40. However, the arrangement in the aforesaid embodiment may shorten a driving time to a large extent. In addition, the second pilot portion 60 issues a closing command to dictate a relatively slow operation, and has been described with reference to the drive portion 62 including the electromagnet 76 and the plate 75 to be attracted thereto. However, the present invention is by no means limited to this instance. For instance, if the drive mechanism in the first pilot portion 40 is adopted for the drive portion 62, then a high speed operation may be attained as in the case of an opening command, or other conventional arrangement may be adopted therefor. Furthermore, an arrangement of the throttle portion 110, drive portion 80 and the like may be substituted by other general arrangements.

Figure 8:
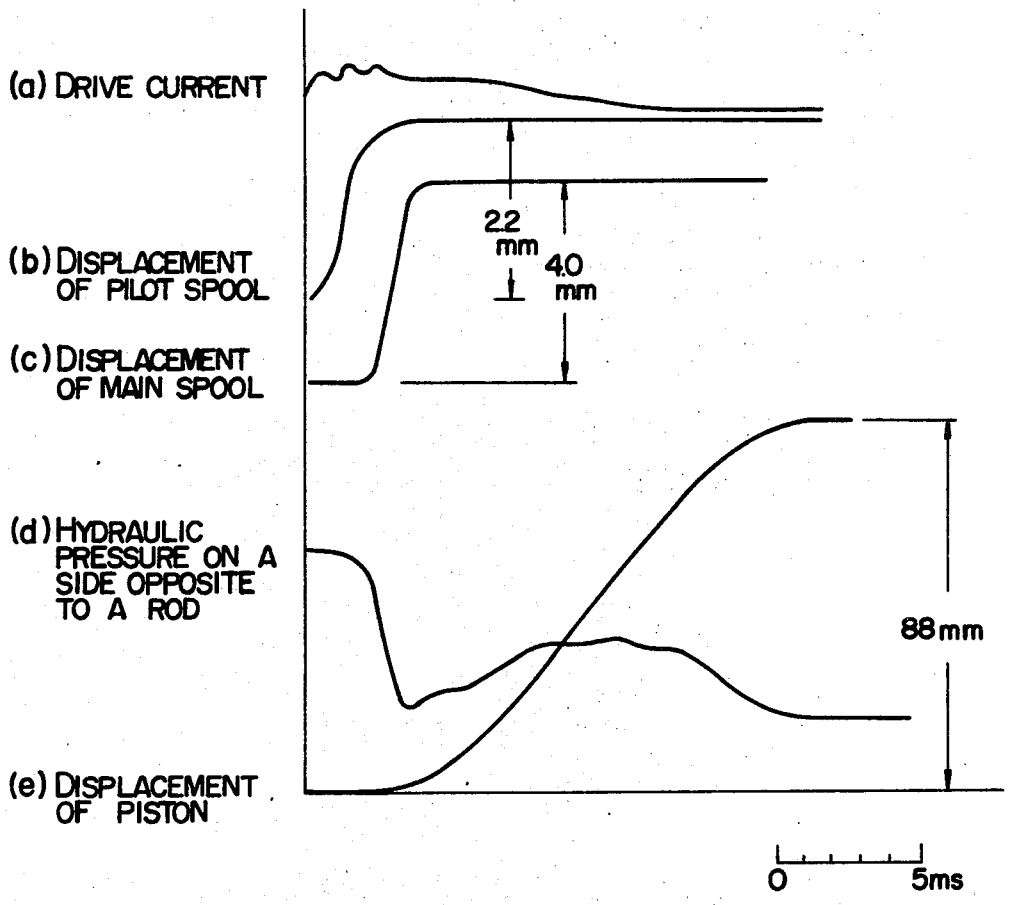
FIG. 8 is a graph showing a comparison of operations of components of a breaker for an electric power, to which is applied a fluid pressure drive device according to the present invention.

Description will be had for an operational speed of the fluid pressure drive device according to the present invention with reference to FIG. 8.

In FIG. 8, represented by an ordinate from above downwards (a) drive current; (b) displacement of spool in pilot portion; (c) displacement of spool in the main control portion; (d) hydraulic pressure in a drive cylinder on a side opposite to the rod; and (e) displacement of a piston in drive portion.

When a command signal is fed, then a force motor pushes a spool in a pilot portion according to a drive current (a) fed from a drive source to the force motor in the pilot portion, so that the spool is displaced at a high speed as shown at (b). As a result, a change-over valve in the pilot portion is changed over, and a fluid pressure urging the spool in the main control portion to the right is relieved, so that the spool is moved to the left at a high speed as short as 1 to 3 ms, as shown at (c). By changing over the main control portion, a high pressure fluid acting on the drive cylinder so as to move to the right is discharged from the control portion into a tank, thereby providing a hydraulic pressure shown at (d), so that a force urging the piston to the right is relieved. In this manner, the piston is displaced as shown at (e), due to a force of a high pressure fluid supplied to the pressure chamber on the side of a rod in the drive portion. In this case, a displacement (e) of the piston may be shortened to $\frac{1}{2}$ to $\frac{1}{3}$, as compared with a conventional device.

As is apparent from the foregoing, according to the present invention, at least parts of the movable members in two drive portions are overlapped in their moving direction to shorten the lengths of fluid passages, so that a time interval, during which a command signal is transmitted to a succeeding drive portion, may be shortened to a large extent.

What is claimed is:

1. A fluid-pressure drive device comprising a plurality of drive portions which are operated in sequence including a primary drive portion and a secondary drive portion responsive to the operation of said primary drive portion, said primary drive portion including a sleeve and said secondary drive portion including a spool, said spool having first and second opposed fluid pressure bearing surfaces for driving said spool between a first position and a second position, fluid pressure on said first fluid pressure bearing surface resulting in a first force urging said spool towards said first position, fluid pressure on said second fluid pressure bearing surface resulting in a second force urging said spool toward said second position, the areas of said first and second fluid pressure bearing surfaces and the fluid pressure applied thereto being such that said first force is greater than said second force whereby said spool is maintained in said first position, first fluid passage means for providing fluid pressure to said first fluid pressure bearing surface, second fluid passage means for providing pressure fluid to said second fluid pressure bearing surface, third fluid passage means for relieving the pressure of fluid against said first fluid pressure bearing surface in response to operation of said primary drive portion whereby said spool is driven from said first position to said second position, the sleeve of the primary drive portion and the spool of said secondary drive portion being in telescoped relation so as to allow the length of fluid passages in said device to be relatively short whereby a relatively high operational speed of said device can be attained and wherein said primary drive portion forms part of a pilot valve means of said device and said secondary drive portion forms part of a control valve means of said device, and wherein operation of said primary drive portion closes said first fluid passage means and opens said third passage means to relieve the pressure of fluid against said first fluid pressure bearing surface whereby said spool is driven from said first position to said second position.

2. A fluid-pressure drive device as set forth in claim 1, wherein one end of the spool in said secondary drive portion telescopes over one end of the sleeve of said primary drive portion, said third fluid passage means for relieving the pressure of fluid against said first fluid pressure bearing surface in response to operation of said primary drive portion including at least one fluid passage formed in said one end of the spool in said secondary drive portion.

3. A fluid-pressure drive device as set forth in claim 1, wherein said spool of the secondary drive portion is formed with a third fluid pressure bearing surface which is opposed to said first fluid pressure bearing surface, said device including fourth fluid passage means for providing said third fluid pressure bearing surface with a pressure fluid as said spool in said control portion is driven from said first position toward said second position in response to operation of said primary drive portion.

4. A fluid pressure drive device as set forth in claim 3, wherein said fourth fluid passage means for providing said third pressure bearing surface with a pressure fluid includes an adjustable throttle portion or restriction so that the flow rate of fluid delivered to said third pressure bearing surface can be adjusted.

5. A fluid pressure drive device as set forth in claim 1, wherein said primary drive portion includes a spool which is moved in response to operation of said primary drive portion in a direction opposite to the direction of movement of the spool in said secondary drive portion when moving from said first position to said second position.

6. A fluid pressure drive device as set forth in claim 1, including means for operating said primary drive portion.

7. A fluid pressure drive device as set forth in claim 5, wherein said means for operating said primary drive portion includes as a drive source a permanent magnet providing a magnetic field, and a driving coil placed in said magnetic field.

8. A fluid pressure drive device as set forth in claim 1, wherein said secondary drive portion includes a sleeve, the sleeve of said secondary drive portion being coupled to the sleeve of said primary drive portion.

9. A fluid pressure drive device as set forth in claim 8, wherein part of the sleeve in said primary drive portion is fitted in the sleeve of said secondary drive portion, thereby establishing said coupling of said sleeves.

10. A fluid pressure drive device as set forth in claim 9, wherein said spool in said secondary drive portion has a poppet portion, and wherein part of the sleeve in said primary drive portion is fitted in said poppet portion of said spool of the secondary drive portion in such a manner that there is formed a fluid chamber between said sleeve in said secondary drive portion and said sleeve in said primary drive portion said first fluid passage means being in communication with said fluid chamber and said first fluid pressure bearing surface of said spool being slidingly fitted in said fluid chamber so that said spool may be driven.

* * * * *